US008069848B1

(12) United States Patent
Larson

(10) Patent No.: US 8,069,848 B1
(45) **Date of Patent: *Dec. 6, 2011**

(54) PILLOW BLOCK BEARING ASSEMBLY FOR COMPOUND BOWS

(75) Inventor: Marlow W. Larson, Ogden, UT (US)

(73) Assignee: Larson Archery Company, Ogden, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/781,319

(22) Filed: May 17, 2010

Related U.S. Application Data

(63) Continuation-in-part of application No. 12/074,930, filed on Mar. 7, 2008.

(51) Int. Cl.
*F41B 5/10* (2006.01)

(52) U.S. Cl. ..... 124/25.6; 124/900

(58) Field of Classification Search ..... 124/23.1, 124/25.6, 86, 88, 900
See application file for complete search history.

(56) References Cited

U.S. PATENT DOCUMENTS

| | | | | | |
|---|---|---|---|---|---|
| 2,872,566 | A * | 2/1959 | Leppala | ..... | 219/132 |
| 3,486,495 | A | 12/1969 | Allen | | |
| 3,990,425 | A | 11/1976 | Ketchum | | |
| 4,461,267 | A | 7/1984 | Simonds et al. | | |
| 4,748,962 | A | 6/1988 | Larson | | |
| 4,774,927 | A | 10/1988 | Larson | | |
| 4,967,721 | A | 11/1990 | Larson | | |
| 4,993,399 | A * | 2/1991 | Chattin | ..... | 124/25.6 |
| 5,535,727 | A * | 7/1996 | Helmuth | ..... | 124/25.6 |
| 5,687,703 | A * | 11/1997 | Vyprachticky | ..... | 124/25.6 |
| 5,791,323 | A * | 8/1998 | Dunlap | ..... | 124/25.6 |
| 6,247,466 | B1 * | 6/2001 | McPherson | ..... | 124/25.6 |
| 6,415,780 | B1 | 7/2002 | Proctor | | |
| 6,763,818 | B2 | 7/2004 | Larson | | |
| 6,990,970 | B1 | 1/2006 | Darlington | | |
| 7,305,979 | B1 | 12/2007 | Yehle | | |
| 7,441,555 | B1 | 10/2008 | Larson | | |

* cited by examiner

*Primary Examiner* — John Ricci
(74) *Attorney, Agent, or Firm* — Brian C. Trask

(57) ABSTRACT

The axles of the eccentric pulley assemblies of a compound bow are journal mounted in pillow blocks carried by the limbs of the bow.

17 Claims, 4 Drawing Sheets

PILLOW BLOCK BEARING ASSEMBLY FOR COMPOUND BOWS

CROSS-REFERENCE TO RELATED APPLICATIONS

This application is a continuation-in-part of U.S. patent application Ser. No. 12/074,930, filed Mar. 7, 2008, titled "PULLEY ASSEMBLY AND AXLE FOR COMPOUND BOWS", the priority of the filing date of which is claimed, and the entire contents of which are hereby incorporated by reference.

BACKGROUND OF THE INVENTION

1. Field

This invention relates to compound archery bows. It is particularly directed to an improved bearing assembly for the pulley assemblies of such bows.

2. State of the Art

Compound archery bows commonly carry assemblies of pulley members (usually called "eccentrics" or "cams") eccentrically mounted on axles in association with respective bow limbs. These limbs extend in opposite directions from a grip (usually comprising a central portion of a handle riser). The rigging for compound bows includes a bowstring trained around the pulley members of the system, the string being received by grooves or other functionally equivalent features at the perimeters of the pulleys. The eccentric pulley assemblies are conventionally mounted to rotate (pivot) on an axle within a notch at the distal end of the limb, or within a bracket structure carried by the limb tip. The eccentrics include one or more pivot holes substantially offset from center, whereby to provide for a reduction in the holding force felt at the nocking point of the bowstring, as the string is moved to its fully drawn condition.

Compound bows and various exemplary riggings, including pulley assemblies, are described by U.S. Pat. Nos. 3,486,495; 3,990,425; 4,748,962; 4,774,927; 4,967,721; 6,763,818 and 7,441,555, the disclosures of which are incorporated as a portion of this disclosure.

The rigging for compound bows typically includes cable segments, which may be end stretches extending from an integral bowstring. More often, however, the cable segments are separate elements, each connecting at one end, directly or indirectly, e.g., through structure associated with the pulley assembly, to a terminal end of the bowstring. The remaining (distal) ends of the cable segments are conventionally connected to the opposite bow limb or structure, such as the pivot axle mount of the pulley assembly carried by that limb. In any case, each cable segment includes one or two stretches oriented approximately parallel the bowstring.

"Approximately parallel," is intentionally fluid in context, merely recognizing that the cable segments and bowstring all extend generally across, but out of contact with, the handle riser portion of the bow between the pulley assemblies, or other structure, carried by the respective bow limbs. All of the cable stretches are thus confined within a space defined by reference planes straddling the handle riser and containing the bowstring. The cable stretches are commonly positioned to one side of the bowstring to avoid interference with the nocking point of the bowstring. It is common practice to mount cable guard rods or other structures to the handle riser. These structures are positioned physically to hold the cables away from the plane of travel of the bowstring. Compound bows have sometimes been configured to position cables on opposite sides of a bowstring so that an arrow may be cast in the plane of the bowstring between cable stretches.

With a compound bow oriented in its normal position of use, it is conventional to consider the bow as being oriented vertically. Unless otherwise stated, the bows referred to in this disclosure are assumed to be in this "vertical" orientation. The handle riser is thus considered to have an "upper end," a "lower end" and a central grip portion. The limb extending from the upper end of the handle riser may be referred to as "a first limb" or the "upper limb," in either case terminating in an "upper limb tip." Corresponding terminology is applied to the "second limb," which extends from the lower end of the handle riser. The bowstring is assumed to travel in a plane ("operating plane") of travel between a fully drawn condition and braced or at rest condition. Cable stretches may be viewed as being positioned to the left or right of the plane of travel of the bowstring, recognizing that in some rigging systems, a cable stretch may be to one side of that plane of travel along the first limb and to the opposite side of that plane of travel as the stretch proceeds to its point of attachment at the second limb.

U.S. Pat. Nos. 3,990,425; 6,990,970; 7,305,979 and 7,441,555 disclose rigging systems that cross-couple the pulley assemblies of a compound bow so that they are constrained to move in unison, thereby providing a self-tuning function to the bow. The term "cross-couple" (sometimes "cross-coupling," or "cross-coupled") designates a rigging in which a cable end that is conventionally attached to a pulley axel is instead attached to a synchronizing sheave of the pulley assembly.

The conventional practice in constructing compound bows has been to mount all pulley components onto stationary axles. Originally, the pulleys were provided with bushings, rotatably mounted on an axle. More recently, these bushings have been replaced with bearing assemblies of various kinds, Exemplary bearing arrangements for compound bows are described and illustrated by U.S. Pat. No. 6,415,780, the disclosure of which is also incorporated as a portion of this disclosure.

The pulley assemblies in common use currently are typically machined, or otherwise formed, from a common block of material. In some instances pulley components are connected together with pins, bolts or screws. In any case, all of the pulley members of the assembly form a unitary structure mounted to turn upon an axle. The axle may be clamped or otherwise fixed with respect to a limb tip of the bow. The '780 patent suggests that pulley assembly axles mounted to turn in bearing assemblies may be press fit into the pulley components. In practice, however, except for the pulley and axle assembly disclosed by parent application Ser. No. 12/074,930, operation of a compound bow is not negatively impacted by rotation of the axle with respect to either the limb tip or the pulley elements, provided the pulley assembly is free to turn around a transverse axis of rotation.

Historically, excessive limb breakage has been associated with the construction practice of positioning an axle directly through channels transverse and within a limb tip of a bow. This problem has been partially alleviated in some constructions by mounting the pulley assembly in a bracket fixed to a limb tip. The use of brackets for this purpose is thought to impact negatively upon bow performance because of the added bracket weight carried by the limb tip under dynamic conditions.

There remains a need for a mounting system capable of associating the limbs of compound archery devices and pulley assemblies of various constructions without the drawbacks and disadvantages of previous arrangements.

SUMMARY OF THE INVENTION

This invention provides a pillow block bearing assembly for associating the limbs and pulley assemblies of compound bows. The axle of the pulley assembly is typically structured for journal mounting at its opposite ends in pillow block assemblies carried by a limb tip. As used in this disclosure, the term "journal mounted" refers to a pivot-enabling interconnection of one structural element to another. A pillow block (sometimes called a Plummer block) is a mounted bearing assembly used to provide support for a rotating shaft with the mounting surface of the bearing assembly parallel to the axis of the shaft. That geometry is considered to be ideal for purposes of this invention. Mounting of the bearing assembly by fasteners that penetrate the limb inherently applies a clamping force to the limb tip, thereby resisting limb failure, such as by delaminating. Suitable such fasteners include threaded fasteners, such as bolts and nuts, rivets, and equivalents.

Alternative bearing arrangements, regarded as equivalent to literal pillow block bearings for purposes of this invention, (and which may be regarded as a type of pillow block), mount the bearings in a fixture that extends outboard from the distal end of a bow limb. The fixture may be clamped, or otherwise anchored, to the limb.

Importantly, pillow blocks suitable for use in the practice of this invention need be neither massive nor heavy. It is thus possible to gain the advantages of this invention while avoiding the disadvantages of either mounting brackets or bore holes through the limbs.

The pillow block assemblies of this invention can be included in any archery device, including traditional compound bows, cross bows and single cam bows, that utilizes axle-mounted pulleys. To avoid duplication of description and other redundancies, however, the invention is described in this specification with primary reference to configurations in which pulley assemblies are carried by opposing similar limbs. It is recognized that the pulley assemblies carried by opposing limbs need not be identical (or exact mirror images). In single-cam embodiments, for example, the corresponding peripheral groove configurations of opposing pulley assemblies will necessarily differ.

A typical pulley assembly includes a string pulley component with a peripheral string groove. The string pulley components of the respective assemblies may be of various cross-sectional configuration, but from an operational perspective, are desirably non-circular. They may be mounted concentrically; that is, to pivot around their geometric centers, but are preferably mounted eccentrically; that is, to pivot around respective axes displaced from their geometric centers.

Opposite ends of a bowstring are preferably connected directly to the respective pulley assemblies such that, at rest condition of the bow, the peripheral string grooves are substantially occupied by wrapped bowstring. The term "groove" should be understood to include any structure capable of receiving or otherwise spooling a length of bowstring or cable. The term "bowstring" refers to the flexible line component of the rigging that contains the nocking point and also wraps around the string pulley components of the respective pulley assemblies. It is recognized that, in practice, the portions of the bowstring that wrap around the string pulley components may actually comprise separate cable segments extending from a central string segment containing the nocking point.

A cable pulley component of each respective pulley assembly presents a peripheral cable take-up groove disposed approximately parallel to, but spaced apart along their common axle from, a corresponding string pulley. The cable pulley and string pulley may, but need not, be affixed to a common integral axle.

The cable pulley components may also be of various cross sectional shape, usually non-circular. In practice, preferred pulley assemblies are constructed with non-circular string and cable grooves, the working portions of which may be variably out of radial and/or circumferential registration with each other with respect to the axle. A synchronizing anchor component may also be included in operable association with each pulley assembly. The synchronizing anchor component may be of either a static or dynamic nature. Static synchronizers are those that enable adjustment of the effective length of a synchronizing cable segment, which then remains "static," or fixed in length during a shooting cycle. Dynamic synchronizers operate to adjust the effective length of a synchronizing cable segment during a shooting cycle. Dynamic synchronizer arrangements are disclosed in detail by U.S. Pat. No. 7,441,555. The rigging may further include stabilizing means structured and arranged to distribute the application of forces through the cables to opposite sides of the pulley assembly, thereby to reduce to a tolerable magnitude, the increased leaning moment typically applied to the pulley assemblies of compound bows as the bowstring is drawn.

The pulley assemblies may be structured with sufficient width to permit passage of a launched arrow between the cables, without the use of a cable guard. In certain embodiments, however, cable-spreading structure is positioned between the cable segments located on opposite sides of the bowstring. Such cable spreading structure may be mounted to extend from the handle riser to between cable stretches located to the right and left of the bowstring. Certain embodiments of the pulley assemblies, particularly those that position all of the cables to one side of the bowstring, are quite narrow, however. Use of a cable guard is generally preferred in those arrangements.

BRIEF DESCRIPTION OF THE DRAWINGS

In the drawings, which illustrate what are currently considered to be the best modes for carrying out the invention.

DETAILED DESCRIPTION OF THE ILLUSTRATED EMBODIMENTS

Figure 1:
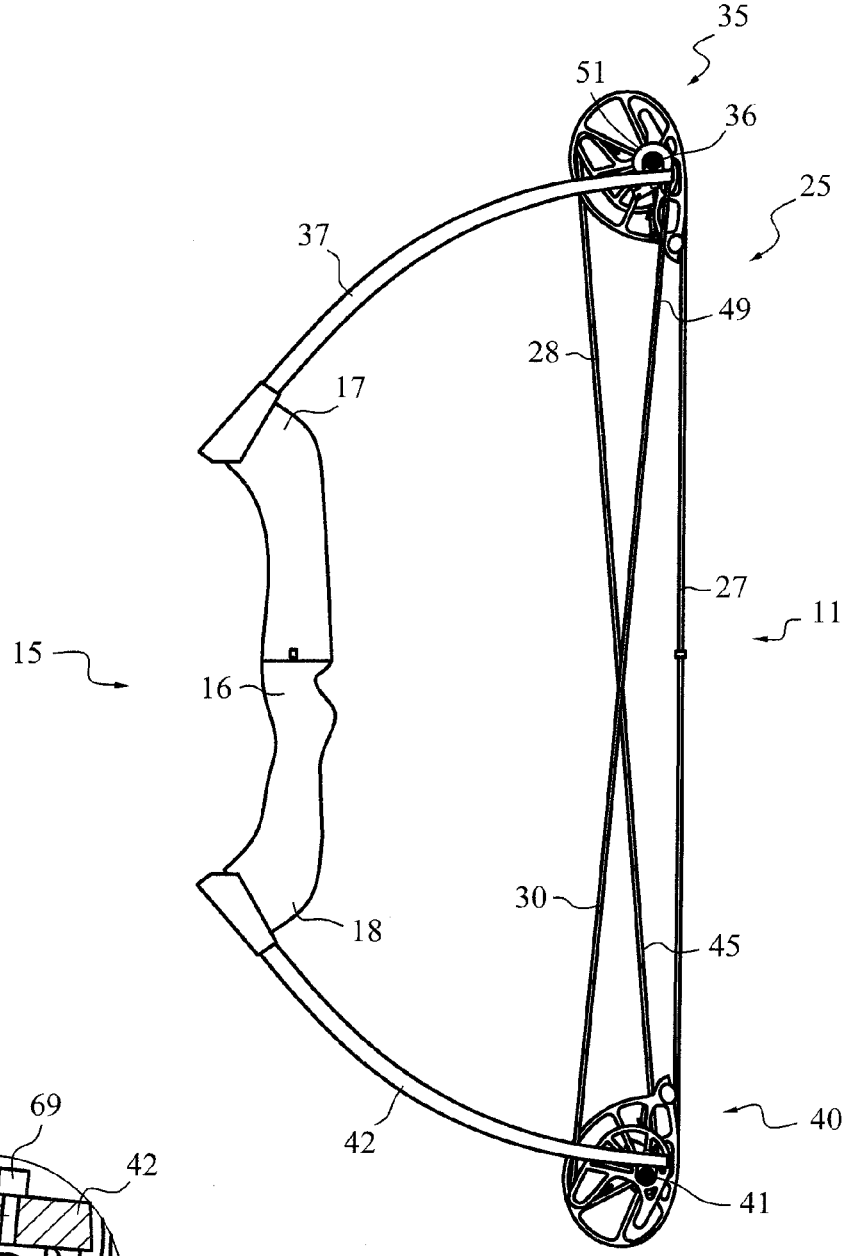
FIG. 1 is a view in side elevation of an archery bow of this invention in "braced" or relaxed condition.

The compound bow, generally 11, illustrated by FIG. 1, is of generally conventional construction. It includes a handle riser component, generally 15, with a grip 16, an upper end 17 and a lower end 18. The rigging, generally 25, includes a bowstring 27, and two synchronizing cables 28, 30. An upper pulley assembly, generally 35, includes an integral pivot axle 36, mounted at the tip of an upper limb 37. A lower pulley assembly, generally 40 similarly includes an integral pivot axle 41 mounted at the tip of a lower limb 42. The rigging 35 is arranged generally as described by copending U.S. patent application Ser. No. 11/241,030, with the synchronizing end 45 of the cable 28 coupled to the pulley assembly 40 through a synchronizing anchor component (not visible). Similarly, the synchronizing end 49 of the cable 30 is coupled to the pulley assembly 35 through a synchronizing anchor component 51. This "cross coupling" configuration, while not required, is a desirable feature for incorporation into the preferred embodiments of this invention. Cross coupling in this fashion provides a self-tuning characteristic to the bow.

Figure 4:
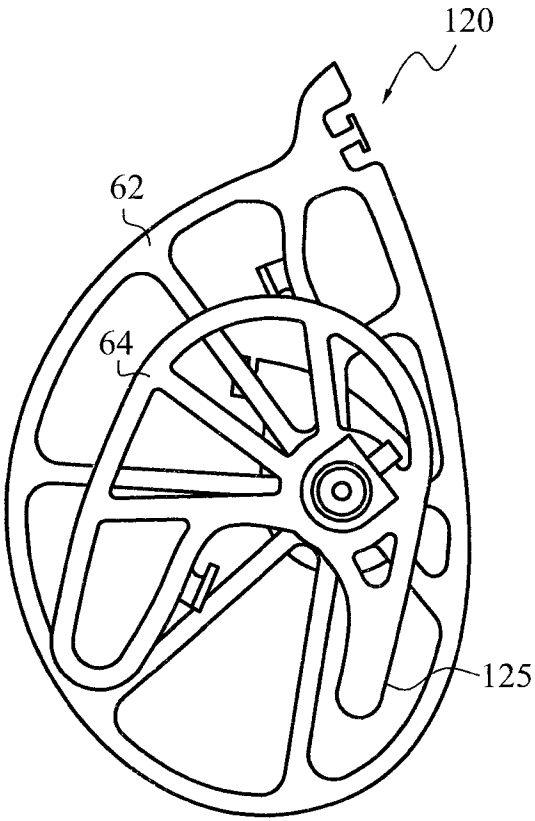
FIG. 4 is a side view of the assembly of FIG. 2, rotated 90 degrees to the right about the same imaginary vertical axis.
Figure 2:
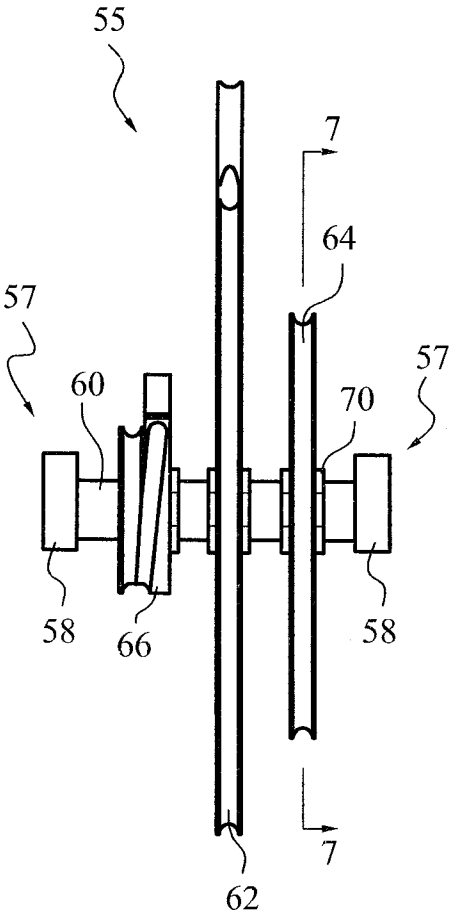
FIG. 2 is a view in front elevation of a pulley assembly structured according to certain principles of this invention.
Figure 3:
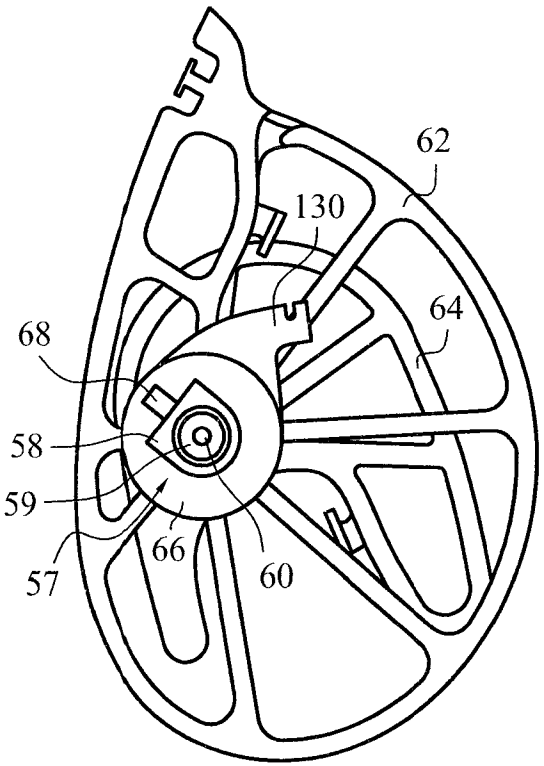
FIG. 3 is a side view of the assembly of FIG. 2, rotated 90 degrees to the left about an imaginary vertical axis.

A presently preferred pulley assembly, generally 55, is illustrated by FIGS. 2 through 4. The mountings, generally 57, are also of a presently preferred pillow block construction. The assembly 55 includes an axle 60, to which are affixed a string pulley component 62, a cable pulley component 64 and a synchronizing pulley component 66. The axle 60 may be made integral with the pulley components 62, 64, 66 by machining an assembly from a single block of material, casting, forging, injection molding, or through any other workable construction to form an assembly from discreet components, such as by welding, gluing, swedging, press fitting or by mechanical fastening devices, such as pins or set screws. In other embodiments, one or more of the pulley components 62, 64, 66 may be free to rotate about the axle 60.

Figure 1A:
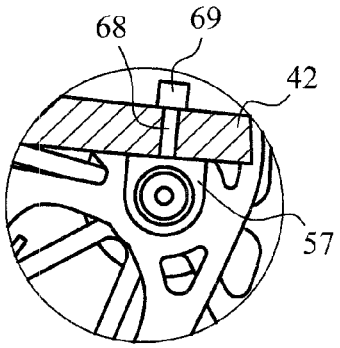
FIG. 1A is a fragmentary view in partial cross-section, to an enlarged scale, taken from the bottom pulley assembly in FIG. 1.

The illustrated mounting 57 includes an outer housing 58 for a bearing assembly 59, through which the axle 60 is journaled. As best shown by FIG. 1A, a depending peg 68 may be inserted through a limb 42, being held in place with a threaded nut or bolt 69 to clamp the mounting 57 in place. A pair of mountings 57 disposed at opposite ends of the axle 60 (See FIG. 2) provide stable, low friction journal mounting for the illustrated assembly 55.

Desirably, a mounting 57 is secured to its respective limb tip with a fastening system that causes a compression through-the-thickness of the tip. Such compression helps to resist delaminating, or splitting, of the limb. Mounting arrangements effective to cause compression through-the-thickness of the tip are made reference to as clamp mounting, clamp mounted, or being in clamping association.

Figure 7:
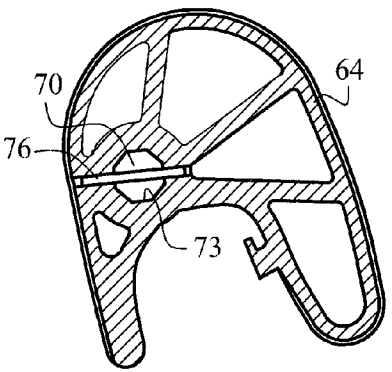
FIG. 7 is a cross sectional view taken along the reference line 7-7 in FIG. 2 and looking in the direction of the arrows.

One practical approach for integrating one or more pulley components to an axle is shown by FIGS. 2 and 7. The portion 70 of the axle 60 extending through the pulley 64 is non-circular, and is dimensioned to register snugly with an opening 73 through the pulley 64. A roll pin 76 holds the pulley 64 against axial movement. With reference to FIG. 2, the ends of the axle 60 may be configured for registration with a central rotating element of a bearing arrangement, such as a ball bearing race disposed in a housing 58.

Figure 5:
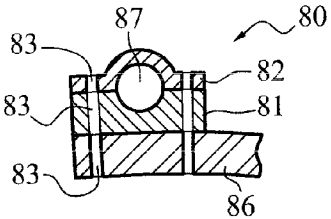
FIG. 5 is a side view in elevation of an alternative bearing mounting assembly.

The bearing assembly illustrated by FIG. 5 is of the type commonly referred to as a "pillow block." A structurally robust outer housing structure, generally 80, includes a base 81 and a cap 82. These elements include extensions with registered bolt holes 83. The housing 80 may be bolted to a limb 86, as shown, to clamp a ball bearing race 87 in mounted position. Therefore, in certain cases, bolts used to assemble the pillow block 80 are also used to clamp mount the pillow block to a limb tip.

Figure 6:
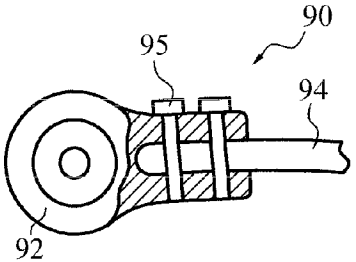
FIG. 6 is a view similar to FIG. 5 of another alternative bearing mounting assembly.

Alternative versions of the pillow block may provide the base 81 and cap 82 as a single element having a bore positioned to receive the ball bearing race 87 (or equivalent bushing or bearing structure). An alternative modified pillow block assembly, generally 90, as illustrated by FIG. 6, includes a rigid (e.g., of metal or hard plastic material) fixture 92 attached to the distal end of a limb 94. Pillow block assembly 90 is of the type that includes a pair of plate elements straddling a limb tip in clamping association. Such clamping association is desirably effective to resist delaminating, or splitting, of the lip. Suitable attachment of a pillow block assembly may be by means of integral formation, gluing or mechanical connectors, such as one or more bolt 95. Preferred attachment of a pillow block 90 places a local portion of the limb tip in compression.

As illustrated in FIG. 6, pillow block 90 is configured to hold an outer race of a bearing to resist rotation of the outer race and to dispose a mounted pulley axle substantially in-line with a length axis of a limb. Put another way, pillow block 90 is configured as a distally protruding limb tip extension to dispose a pulley axle, that is journal mounted therein, substantially transverse to a length axis of a limb on which the pillow block may be mounted, the axle being essentially disposed between plane extensions of a front and back of the limb tip.

Mountings may be disposed on opposite sides of a notch in a limb tip, where the notch is adapted to accommodate rotation of one or more pulley elements. In other cases, mountings may be disposed on adjacent limbs of a split-limb bow, effective to dispose at least one pulley element between those split limbs. Preferred installation arrangements for a pillow block cause a compression in the limb tip at the mounting location.

Figure 8:
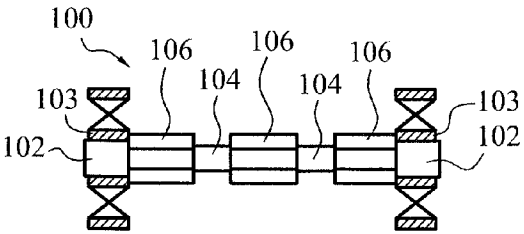
FIG. 8 is a side view of an axle suitable for certain embodiments of the invention.

As shown by FIG. 8, an axle, generally 100, may be constructed with various cross sectional configurations to serve different functions along discrete segments. In the specific instance illustrated, the end segments 102 are configured to snuggly fit into spaced apart bearing races 103. The illustrated strain segments 104 are of reduced diameter selected to strain slightly under opposing torques of the magnitude expected to develop during the draw portion of a shooting cycle. It is within contemplation to form an alternative strain segment having a hollow core and increased diameter (or other shape having a larger characteristic size), adapted to maintain bending stiffness of the axle while enhancing its rotational compliance under torque. The segments 106 have a hexagonal cross section sized to register with cooperatively structured axle passages of individual pulleys.

Figure 9:
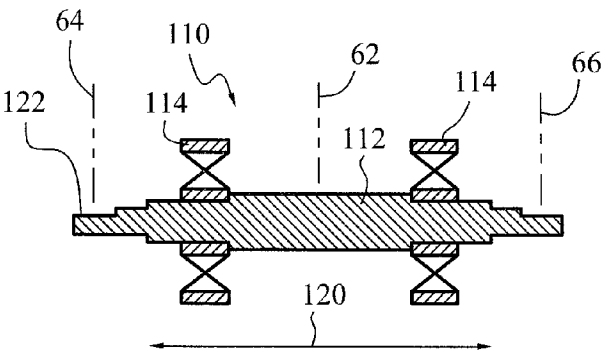
FIG. 9 is a side view of another operable axle.

Another operable axle, generally 110, is illustrated in FIG. 9. A central stretch 112 of axle 110 is structured for its disposition between mountings 114. Central stretch 112 may have any desired cross-sectional shape, although a noncircular shape adapted to form a structural interference with a bore through a string cam is preferred. Furthermore, the cross-section may vary along the length of stretch 112 (e.g. to provide a rotational strain zone), rather than the illustrated substantially constant cross-section.

A string pulley may be installed to rotate with axle 110 in a plane as indicated generally at line 62. A cable pulley 64 and a synchronizer pulley 66 may respectively be affixed to rotate with axle 110 at locations outboard of mountings 114, in planes indicated by their correspondingly numbered lines. In such an arrangement, a bow limb tip may be disposed between the cable pulley and string pulley, e.g. in the zone indicated by arrow 120. The outboard pulleys 64, 66 may be anchored to the axle 110 in several ways, nonexclusively including using a press-fit, roll or dowel pin, or a set screw arrangement. As illustrated, axle 110 includes a flat surface 122, adapted to cause a structural interference with cooperating structure of an axle bore in each outboard pulley member.

Figure 4A:
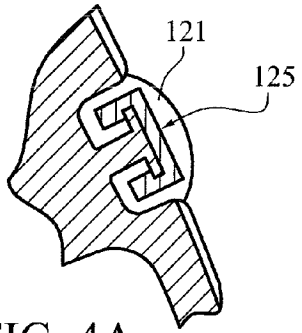
FIG. 4A is a fragmentary perspective view to an enlarged scale, taken from FIG. 4, and including a representative damping element.

The pulley members illustrated by FIGS. 1-4 incorporate a number of advantageous features. A well and post fixture, generally 120 (FIG. 4), is structured to receive and anchor a resilient bumper member 121 (FIG. 4A). This bumper 121 is in contact with the bowstring 27 in braced condition, thereby serving as a string dampener following the launch of an arrow. The peripheral surface 125 comes into rigid contact with a cable 28, 30 at full draw, thereby preventing overdraw, or cocking, of the bow. A notable characteristic of the illustrated synchronizing pulley 66 (FIG. 3) is its cable attachment extension 130.

Figure 10:
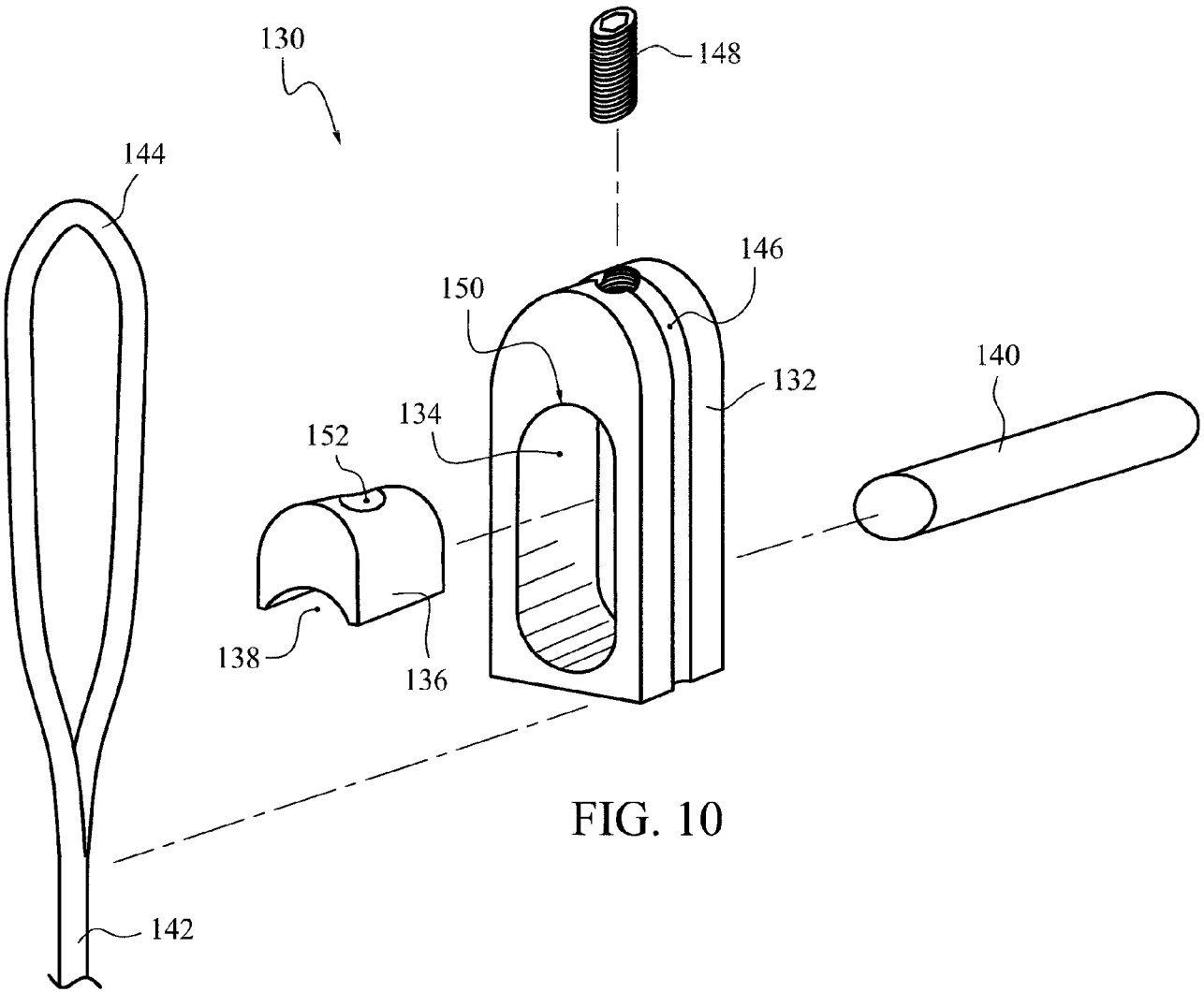
FIG. 10 is an exploded view of a static synchronizer useful for certain specific embodiments of this invention.

With reference now to FIG. 10, an exemplary static synchronizer is illustrated generally at 130. When present, a static synchronizer essentially replaces the dynamic synchronizer component of a pulley assembly. Static synchronizer 130 has a body 132 providing an elongate aperture 134 in which is received presser-foot 136. Body 132 may be made from a metal, such as Aluminum, or from a suitable plastic or nylon material, or the like. It is currently preferred to injection mold body 132.

As illustrated, a presser-foot 136 may include a saddle area 138 adapted to seat in compression against a portion of an axle 140, which typically carries the remainder of the pulley assembly at a limb tip. Because the axle 140 rotates during the draw and release of an arrow, and slides with respect to the presser-foot 136, it is desirable to form a presser-foot from a material having a low coefficient of friction, such as Teflon. In alternative embodiments, an equivalent presser foot may include a rolling bearing element arranged to interface with the moving axle, rather than the illustrated rubbing or sliding interface.

A terminal end of a bowstring element, or cable 142, is anchored with respect to a limb tip by the static synchronizer 130. In the embodiment illustrated in FIG. 10, a terminal loop 144 of cable 142 is received in groove 146. Alternative anchoring arrangements are within contemplation, including causing an interference between an enlargement (e.g. swedged fitting) carried by the cable, and a socket carried by the static synchronizer. Provision is made to permit adjusting a length of the cable 142 (by displacing an effective anchor location of terminal end 144) to provide synchronization between the pulley elements disposed at opposite limb tips. In the illustrated embodiment, a length adjustment is effectively made by adjusting set screw 148 to variably space presser-foot away from the top surface 150 of aperture 134. Advancing the set screw 148 causes an effective shortening of cable 142.

If desired, a socket 152 may be provided to cooperate with the advancing end of set screw 148 and thereby maintain presser-foot 136 in desired registration inside aperture 134. The axle 140 may sometimes include shoulder structure(s) (not illustrated) disposed to resist migration of body 132 along a length axis of the axle 140. Alternatively, the body 132 may simply be trapped between an outboard bearing assembly and the remainder of the pulley assembly, which is typically affixed to axle 140. In such case, sleeve spacers may sometimes be employed to locate the body 132 at a desired position along an axle. In any case, the axle is disposed in registration with respect to a limb tip by journal mounting opposite ends of the axle in a respective bearing assembly.

The pillow block bearing assemblies of this invention have been described with particular reference to bow constructions that are presently preferred because of advantageous features not directly related to specific bearing constructions. The pillow block bearings of this invention enhance the advantages offered by dynamic synchronizers and/or integral axels, for example. The claimed bearing assemblies may also be advantageously relied upon to mount the pulley assemblies of virtually any other archery device.

What is claimed is:

1. A compound archery bow comprising:

first and second pulley assemblies, each including a pivot axle;

first and second pillow block mounting assemblies rigidly attached to respective first and second limbs of said compound archery bow;

said pivot axles of said first and second pulley assemblies being journal mounted in respective said first and second pillow block mounting assemblies.

2. A compound archery bow according to claim 1, wherein said pillow block mounting assemblies are clamp mounted to said limbs.

3. A compound bow according to claim 2, wherein each said pillow block assembly includes a base plate clamp mounted to a said limb by means of at least one fastener constructed and arranged to penetrate said limb.

4. A compound bow according to claim 3, wherein said fastener is a threaded connector, rivet or equivalent.

5. A compound bow according to claim 1, wherein each said pillow block assembly includes a pair of plate elements straddling a said limb in clamping association.

6. A compound archery bow that includes:

a handle having projecting limbs;

a first pulley assembly, including a first axle, journal mounted on a first of said limbs for rotation around a first axis;

a second pulley assembly, including a second axle, journal mounted on a second of said limbs for rotation around a second axis; and bow cable means including a bowstring cable extending from bowstring let-out grooves of said first and second pulley assemblies, a first cable extending from a cable take-up groove of said first pulley assembly to second cable let-out means mounted to rotate on said second axis, and a second cable extending from a cable take-up groove of said second pulley assembly to first cable let-out means mounted to turn on said first axis such that draw of said bowstring cable away from said handle lets out bowstring cable from said let-out grooves on said first and second pulley assemblies, rotates said first and second pulley assemblies around said axes, and lets out portions of said first and second cables from said first and second cable let-out means on said first and second pulley assemblies.

7. A compound archery bow according to claim 6, wherein each of said pulley assemblies includes an axle and the opposite ends of respective said axles are journal mounted in pillow block bearing assemblies carried at the distal ends of respective said limbs.

8. Rigging for a compound archery bow comprising:

first and second pulley assemblies mounted to pivot on respective axles that are journaled in pillow blocks carried by respective said first and second limbs of a compound bow; each said pulley assembly including:

a string pulley component with a peripheral string groove;

a cable pulley component with a peripheral cable take-up groove;

an axle fixed to said string pulley and said cable pulley; and a pulley synchronizing component;

a bowstring with opposite ends connected to said first and second pulley assemblies such that, at rest condition of the bow, the peripheral string grooves are substantially occupied by wrapped bowstring;

a first cable segment, extending from the entry of the peripheral cable take-up groove of said first assembly to said synchronizing component of said second pulley assembly; and a second cable segment, extending from the entry of the peripheral cable take-up groove of said second assembly to said synchronizing component of said first pulley assembly;

said first and second pulley assemblies being structured and arranged such that as said bowstring is pulled from its said rest position towards its drawn position, respective first ends of said first and second cable segments wrap onto the peripheral cable take-up grooves of said first and second pulley assemblies, respectively, and respective second ends of said first and second cable segments operably interact with the synchronizing components of said second and first pulley assemblies, respectively.

9. The rigging according to claim 8, wherein:

said pulley synchronizing component is dynamic.

10. The rigging according to claim 8, wherein:

said pulley synchronizing component is static.

11. The rigging according to claim 8, wherein:

at least one of said pillow blocks is clamp mounted to a limb tip.

12. The rigging according to claim 11, wherein:

a pillow block comprises a base element and a removable cap element, said base and said cap being cooperatively configured to permit clamping a bearing element therebetween.

13. The rigging according to claim 12, wherein:

said pillow block is structured and arranged to permit fasteners that assemble said base and said cap also to clamp mount said pillow block onto a limb tip.

14. The rigging according to claim 8, wherein:

an anchoring arrangement of a pillow block with respect to a limb tip provides a clamp effect on said limb tip.

15. The rigging according to claim 14, wherein:

said clamp effect causes a local compression in the limb tip.

16. The rigging according to claim 8, wherein:

at least one pillow block is configured to hold an outer race of a bearing assembly effective to resist rotation of said outer race.

17. The rigging according to claim 16, wherein:

said pillow block is configured as a distally protruding limb tip extension to dispose a pulley axle, that is journal mounted therein, substantially transverse to a length axis of a limb on which said pillow block may be mounted, said axle being essentially disposed between plane extensions of a front and back of said limb tip.

* * * * *